United States Patent [19]

Zocher

[11] 4,245,577

[45] Jan. 20, 1981

[54] LOCKSTITCH SEWING BY NEEDLE LOOPER

[75] Inventor: Josef Zocher, Aachen, Haaren, Fed. Rep. of Germany

[73] Assignee: The Singer Company, Stamford, Conn.

[21] Appl. No.: 33,297

[22] Filed: Apr. 25, 1979

[51] Int. Cl.[3] ..... D05B 57/08; D05B 85/10

[52] U.S. Cl. ..... 112/262.1; 112/184

[58] Field of Search ..... 112/98 (U.S. only), 112/181, 184, 191, 262.1

[56] References Cited

U.S. PATENT DOCUMENTS

| | | | |
|---|---|---|---|
| 544,723 | 8/1895 | Cornely | 112/98 |
| 2,242,528 | 5/1941 | Kozibroda | 112/98 |
| 2,426,636 | 9/1947 | Monroe | 112/98 |
| 2,887,966 | 5/1959 | Felton | 112/79.5 |

FOREIGN PATENT DOCUMENTS

| | | |
|---|---|---|
| 429787 | 9/1964 | Japan . |
| 779671 | 7/1957 | United Kingdom . |

*Primary Examiner*—Wm. Carter Reynolds

*Attorney, Agent, or Firm*—Edward P. Schmidt; Robert E. Smith; Edward L. Bell

[57] ABSTRACT

A lockstitch sewing machine utilizing a needle looper to extend upwardly through a work material to grasp an upper thread and pull it downwardly through the work material to a looptaker which casts the upper thread about a lower thread in order to form a lockstitch. When the needle looper is in an upper position to catch an upper thread, a hook needle is exposed and thread is deflected into the hook thereof. As the needle looper is retracted to a depressed position the hook needle is moved to a guard position so as to retain the upper thread therein during transit. When the needle looper is at its lower position, the hook is again exposed to release its thread to a looptaker for concatenation with a lower thread.

1 Claim, 10 Drawing Figures

LOCKSTITCH SEWING BY NEEDLE LOOPER

DESCRIPTION

BACKGROUND OF THE INVENTION

This invention is concerned with sewing machines, more particularly with a lockstitch sewing machine.

Heretofore known lockstitch sewing machines utilize an upper needle having a thread carrying eye located at the tip thereof to carry an upper thread downwardly through a work material to a looptaker, for pickup thereby and concatenation about a lower thread. Since the early days of the sewing machine, the growth of the industry has been predicated upon improvements to this basic method of forming a lockstitch. The instant invention, however, is not concerned with an improvement to the old basic method of generating a lockstitch, but pertains to an entirely new means by which a lockstitch may be accomplished.

SUMMARY OF THE INVENTION

In this invention, the upper thread passes through the sewing machine thread tension and takeup lever as heretofore known. However, thereafter the upper thread is acted upon by deflecting levers in order to position the thread to be accepted by a hook needle carried by a needle looper. The needle looper is best implemented by an outer, work material piercing, needle; which outer needle surrounds an inner hook needle. The needle looper is capable of endwise reciprocation up through a work material from the bottom side thereof, and to expose the inner hook needle portion thereof to permit an upper thread to be deflected therein. The inner hook needle is thereupon retracted into the outer needle in order to prevent escape of the upper thread therefrom, and the needle looper assembly is retracted through the work material to a lowered position. Means are provided to re-extend the inner hook needle from the outer needle when at the lower extremity of travel of the needle looper assembly so as to permit the upper thread retained thereby to be caught by a looptaker and withdrawn from the inner hook needle in order to be cast about a lower thread carrying bobbin for concatenation with the lower thread prior to the upward excursion of the needle looper assembly in the formation of the succeeding lockstitch. The lockstitch sewing machine thus described does not require a needle which must be threaded, using instead the needle looper assembly, which in conjunction with the loop deflecting levers catches an upper thread for each stitch.

DESCRIPTION OF THE DRAWINGS

The subject matter which is regarded as the invention is particularly pointed out and distinctly claimed in the concluding portion of this specification. The invention itself, however, both as to its organization and method of operation thereof may be best understood by reference to the following description taken in connection with the accompanying drawings, in which:

Figure 1:
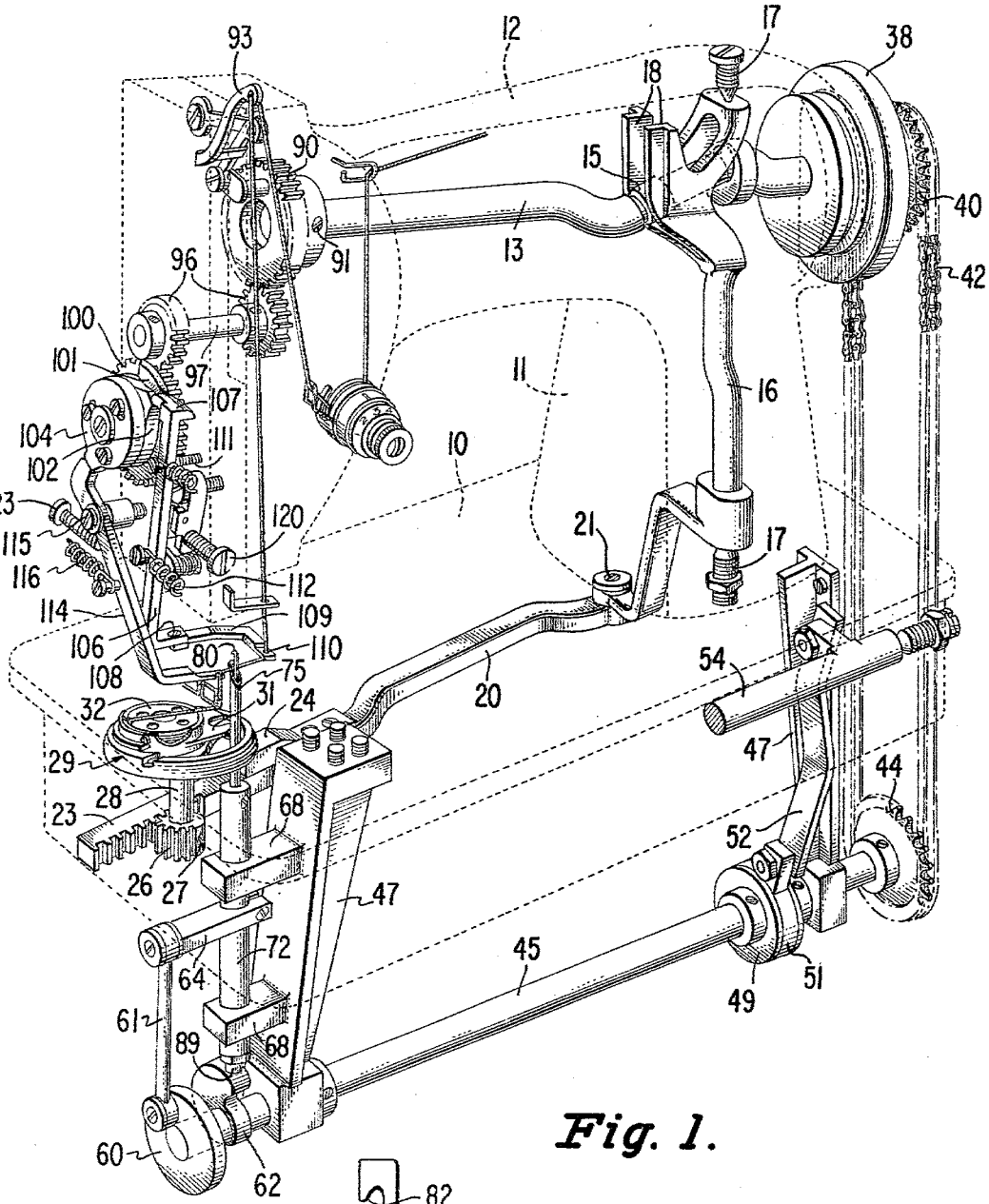
FIG. 1 is a perspective view of a sewing machine including fragments of a typical work feeding mechanism and illustrating the physical elements necessary to an embodiment of this invention applied thereto.

With reference to the drawings, the invention is incorporated in a sewing machine having a frame shown in phantom and including a hollow work supporting bed 10 with a hollow standard 11 rising from one end thereof and terminating at its upper end in a hollow bracket arm 12 that extends laterally over the work supporting bed.

A main shaft 13 is rotatably mounted within the hollow bracket arm 12 and extends longitudinally therethrough. The main shaft 13 has a crank 15 formed in an intermediate portion thereof with a cam surface thereon. A pitman 16 is pivotably mounted in the hollow standard 11 by means of pintal screws 17. At its upper end, the pitman 16 is slotted to provide a cam follower 18 in engagement with the cam surface of the crank 15.

A stitch forming mechanism drive bar 20 is pivotally connected to the bottom of the pitman 16 by means of a pivot screw 21. A rack element 23 and a cam member 24 are connected to the free end of the drive bar 20. The teeth of the rack 23 are in engagement with the teeth of a drive pinion or gear 26 which is connected by means of a set screw 27 to the bottom of a vertical axis looptaker shaft 28 to which a conventional form of looptaker 29 is affixed. Supported within the looptaker 29 against oscillation therewith is a bobbin case 31 which carries internally thereof bobbin 32. Thus, as the main shaft 13 is turned under the urgings of a main drive motor (not shown), the pitman 16 is urged to undergo oscillation by the action of the crank 15 against the slotted cam follower 18 of the pitman, this action causing the drive bar 20 to engage in to and fro motion oscillating the looptaker 29 and by means of cam 24 encouraging lift of the feed dogs (not shown).

At the outer end of the main shaft 13, there is supported a handwheel 38. Adjacent the handwheel 38 there is connected a sprocket 40, which sprocket carries a chain 42 connected to a lower sprocket 44 carried on a lower shaft 45. The lower shaft 45 is journalled in bearings which are carried in extensions 47 depending from the work supporting bed 10. A feed eccentric 49 is supported by the lower shaft 45, the eccentric being encircled by a collar 51 which is connected by a link 52 to the rock arm of a feed rock shaft 54 for imparting feed and return motion to the feed dogs (not shown) alternately with the lifting and falling action imparted by cam 24.

Figure 6:
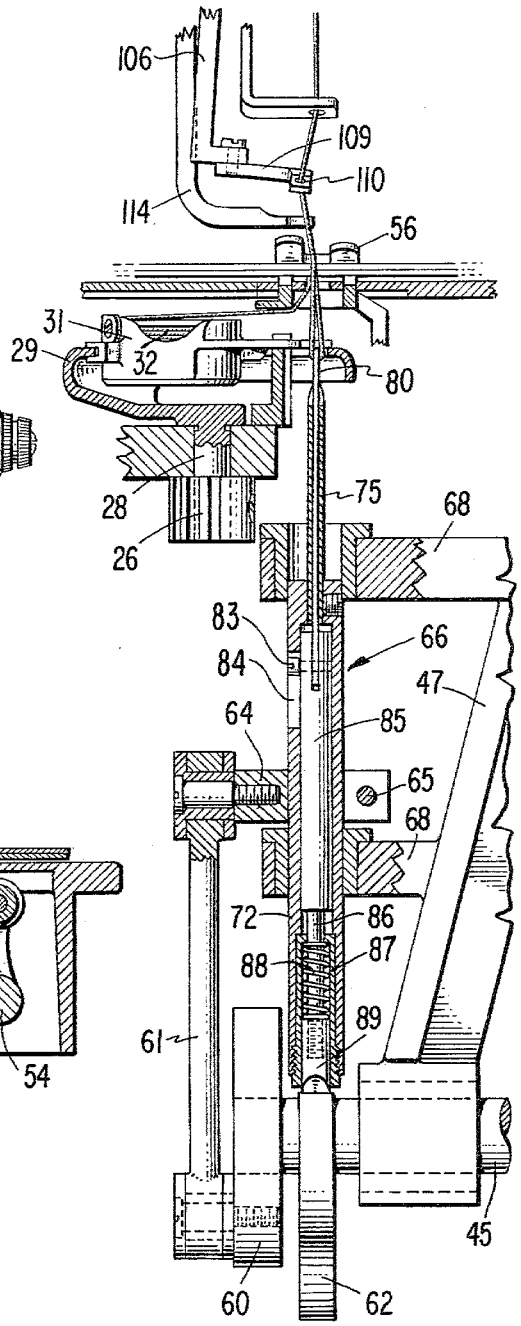
FIG. 6 is a cross sectional view of the needle looper assembly shown in the lowermost position and its relation to the looptaker.

Referring to FIG. 6, on the end of the lower shaft 45 opposite the sprocket 44 there is supported a crank 60, and spaced inwardly thereof a cam disk 62. The crank 60 is connected by way of connecting rod 61 to a lug 64 transverse of and affixed to an upright needle looper assembly 66 by means of screw 65. The needle looper assembly 66 is urged in vertical endwise reciprocation by the crank 60 and connecting rod 61 within bearings provided in appendages 68 affixed to an adjacent extension 47. The needle looper assembly 66 includes a tube 72 which slides within bearings in the appendages 68, the tube having a constricted bore at the upper end to receive an outer needle bar 75 therein. The outer needle bar 75 is fashioned with a hollow interior and at the end thereof tapers to a point 76 at a shallow angle so as to provide ready penetration of a work material (see FIG. 2). Approximately midway of the taper there is formed a scallop 78 for a purpose to be explained below.

Figure 2:
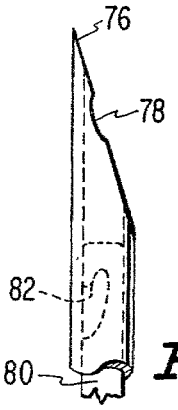
FIG. 2 is an elevation of the end of the needle latch assembly as it would appear during penetration of a work material.
Figure 3:
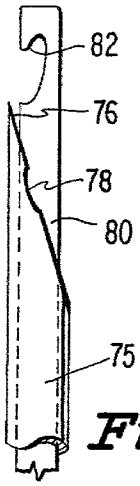
FIG. 3 is an elevation similar to FIG. 2 showing however the arrangement of parts of the needle latch assembly as they would appear at both the uppermost and lowermost extreme position thereof.
Figure 4:
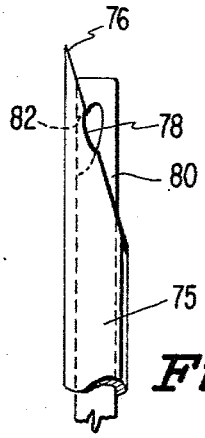
FIG. 4 is an elevation of the needle latch assembly as it would appear after the upper thread had been caught by the needle latch assembly and is being transported to the looptaker.

Internally of the outer needle bar 75 there is situated a rod-like inner needle bar 80. The inner needle bar 80 extends the length of the outer needle bar 75 and into the tube 72 where it is fastened to a piston 85 by a screw 83, which screw slides in a slot 84 in the tube so as to maintain orientation of the inner needle bar to the outer needle bar. The upper end of the inner needle bar 80 is fashioned with a hook 82, which hook in certain positions of the inner needle bar with respect to the outer needle bar 75 creates a thread carrying eyelet with the scallop 78 in the outer needle bar (see FIG. 4). The lower end of the piston 85 is fashioned into a spindle 86, the bottom end of which is threaded to receive a cup 87. A spring 88 is carried on the spindle 86 between the cup 87 and a cap 89 threadedly attached to the bottom end of the tube 72. Thus, by reference to FIG. 6 it can be seen that the cup 87 urged into engagement with the cam disk 62 by the spring 88 so that the inner needle bar 80 may be raised or lowered and extended from the outer needle bar in accordance with the periphery on the cam disk. The entire needle looper assembly 66 reciprocates endwise through the looptaker 29 adjacent the looptaking beak 30 thereof and upward through a presser foot 56 carried on a presser bar 57. Thus, the needle looper assembly 66 is urged in endwise reciprocation by the crank 60 while simultaneously the inner needle bar 80 thereof partakes of independent motion in syncronism with the outer needle bar under the urgings of the cam disk 62. Referring to FIG. 2 there is shown the position of the inner needle bar 80 with respect to the outer needle bar 75 during its ascent and when the point 76 of the outer needle bar is penetrating the work material supported on the work supporting bed 10 of the sewing machine. In FIG. 3 there is shown the position of the inner needle bar 80 with respect to the outer needle bar 75 when the needle looper assembly 66 is at either extreme of its upper or lower position. As will be explained below, in this position the hook 82 of the inner needle bar 80 is exposed to receive an upper thread in the upper position, or to release the upper thread in the lower position. In FIG. 4 there is shown the position of the inner needle bar 80 with respect to the outer needle bar 75 after an upper thread has been picked up by the hook 82 of the inner needle bar and while the upper thread is being transported through the work material to a lower position for release.

Figure 5:
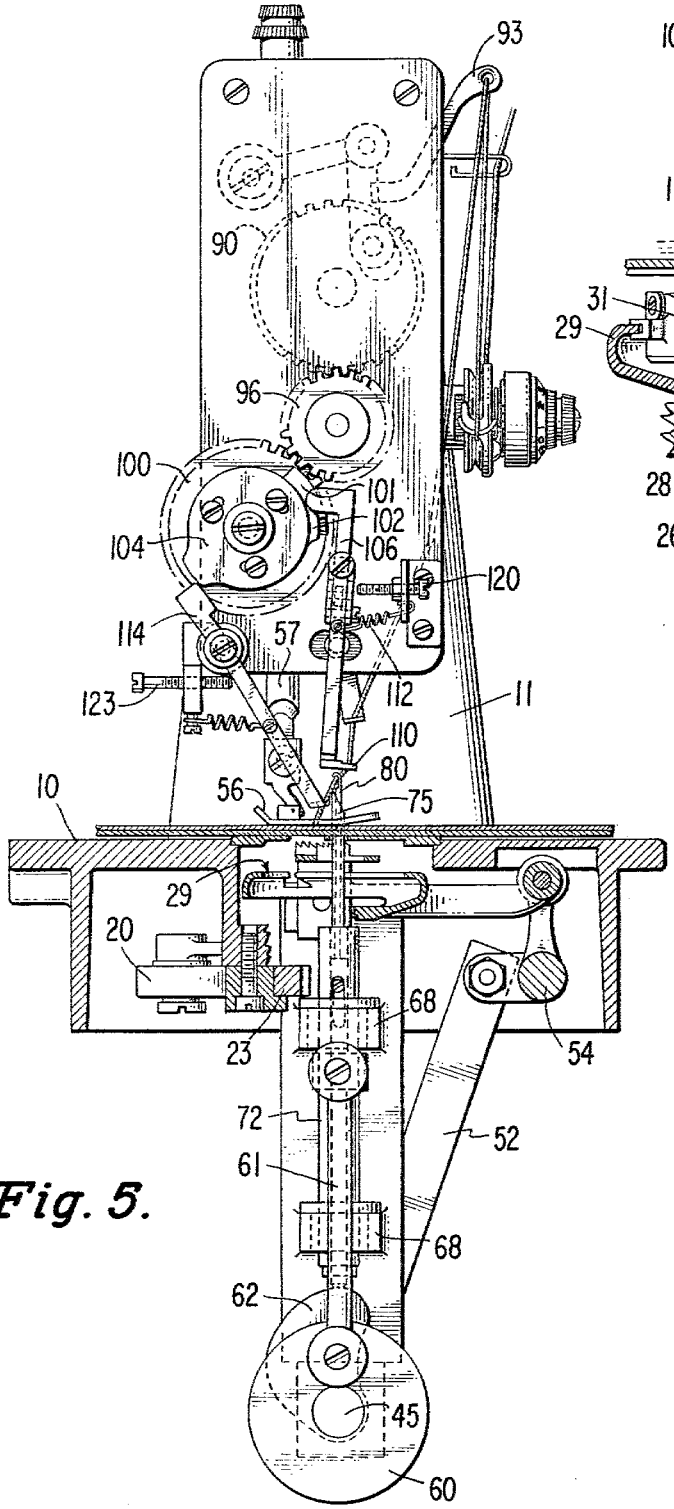
FIG. 5 is an end elevation of the sewing machine shown in FIG. 1 showing the needle looper assembly in the uppermost position.

Referring to FIGS. 1 and 5, the end of the main shaft 13 supports a gear and crank combination 90 which is affixed to the main shaft by screw 91. The gear and crank 90 actuates a takeup lever 93 to provide, as is well known in the sewing machine art, thread to the looptaker 29 for enlarging of the loop and passing it around the bobbin case 31 and bobbin 32 and subsequent takeup of the slack thread. The gear and crank combination 90 also drives intermediate gears 96 supported on idler shaft 97 in the head of the sewing machine. An intermediate gear 96 is connected to a gear 100 to which there is adjustably attached two one lobe cams 102 and 104. The cam 102 includes a face cam portion 101 on the gear 100. A thread guide lever 106 is fashioned with an abutment 107 in engagement with one lobe cam 102 and the face cam portion 101. The end of the thread guide lever 106 opposite the abutment 107 is fashioned with a thread guide 109 having an eyelet 110 in one end and attached to the lever 106 by screw 108. Movement of the thread guide lever 106 by the one lobe cam 102 and face cam portion 101 manipulates the eyelet 110 at the end of the lever for a purpose which will be explained below. The thread guide lever 106 pivots on screw 111 carried by the head end of the sewing machine. A biasing spring 112 is carried on a bracket (not shown) affixed to the head end of the sewing machine and is attached to the thread guide lever in a fashion to maintain contact between the abutment 107 thereof and the one lobe cam 102 and face cam portion 101.

Figure 9:
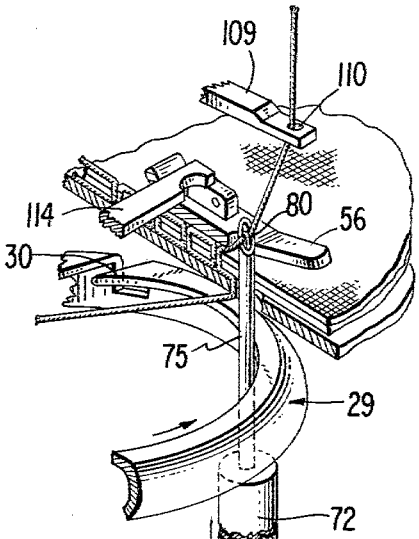
FIG. 9 is a perspective view similar to FIG. 7, shown however after grasping an upper thread and during transit of the needle looper assembly to a lowermost position; and, FIG. 10 is a plan view of the presser foot, needle looper assembly and thread manipulating members to show the action thereof which directs the upper thread into the hook of the needle looper assembly.
Figure 10:
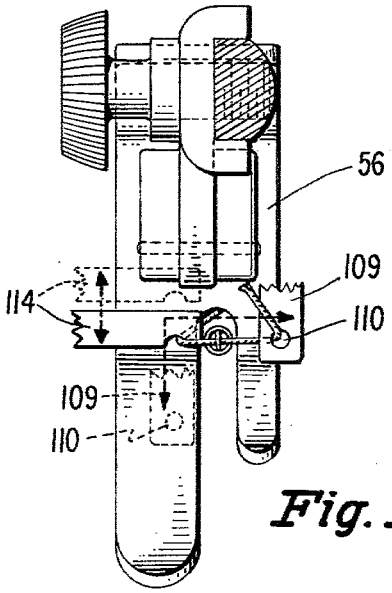

A notched lever 114 is pivoted on screw 115 attached to the head end of the sewing machine and is biased by spring 116 connected to a bracket (not shown) so as to maintain the abutment 117 of the notched lever in engagement with the one lobe cam 104. The notched end 118 of the notched lever 114 is arranged adjacent the line of stitching so that it will engage the upper thread extending to the work material and wrap that thread about the inner needle bar 80 into the hook 82 thereof when the needle looper assembly 66 is positioned as shown in FIG. 3 of the drawings in the uppermost position. The cam 102 and the face cam portion 101 will operate upon the thread guide lever 106 to cause the thread guide 109 and eyelet 110 thereof to pivot about the screw 111 initially in a rearwardly direction and when actuated by the face cam portion laterally to the right. This motion is shown in FIG. 10 where the initial position of the eyelet 110 is shown in phantom and the final position thereof is shown in full. This motion will step the upper thread initially to a position behind the hook 82 of the inner needle bar 80 and then to a position laterally to the other side of the inner needle bar. Thereafter the cam 104 will actuate the notched lever 114 to have the notched end 118 thereof sweep the end of the upper thread extending through the throat plate into the hook 82 so that as the hook is retracted to the position shown in FIG. 4 an upper thread will be grasped in the eyelet formed with the scallop 78 of the outer needle. Thereafter, as is shown in FIG. 9, the inner needle bar 80 is withdrawn to the interior of the outer needle bar 75 and the needle looper assembly 66 draws the upper thread down to the looptaking beak 30 of the looptaker 29 (see FIG. 9). In FIG. 1 it will be seen that the needle looper assembly 66 is in the uppermost position with the inner needle bar 80 extended in a thread receiving attitude. The follower end of the inner needle bar 80 is engaged with the cam disk 62 adjacent an abrupt discontinuity thereof, and continued counterclockwise movement of the cam disk, as viewed from the crank 60, will permit the inner needle bar to fall and assume the position shown in FIG. 4. Thereafter the contour of the cam disk 62 is fashioned to synchronize the travel of the inner needle bar 80 with the outer needle bar 75. When the needle looper assembly 66 approaches the lower position of its travel the cam disk 62 is formed so as to reinitiate the relative position of the outer needle bar and inner needle bar illustrated in FIG. 3 to permit the looptaker to seize the loop therefrom. A stop screw 120, supported by bracket 121 affixed to the head of the sewing machine limits the retrograde motion of the thread guide lever 106 as urged by the biasing spring 112. A similar stop screw 123 is also supported by a bracket in order to limit the retrograde movement of the notched lever 114.

Figure 8:
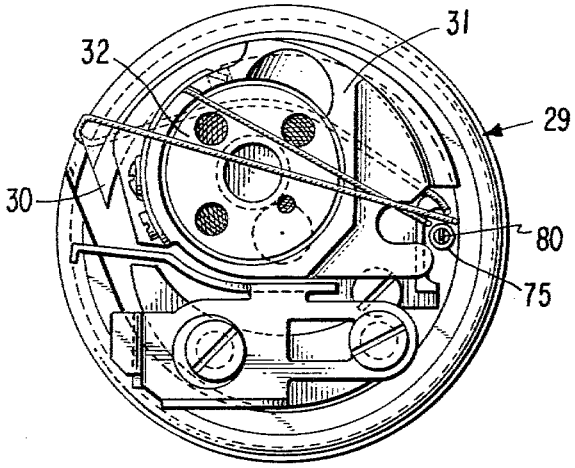
FIG. 8 is a plan view of the looptaker and bobbin case supported therein in the process of loop expansion and casting about the bobbin case.
Figure 7:
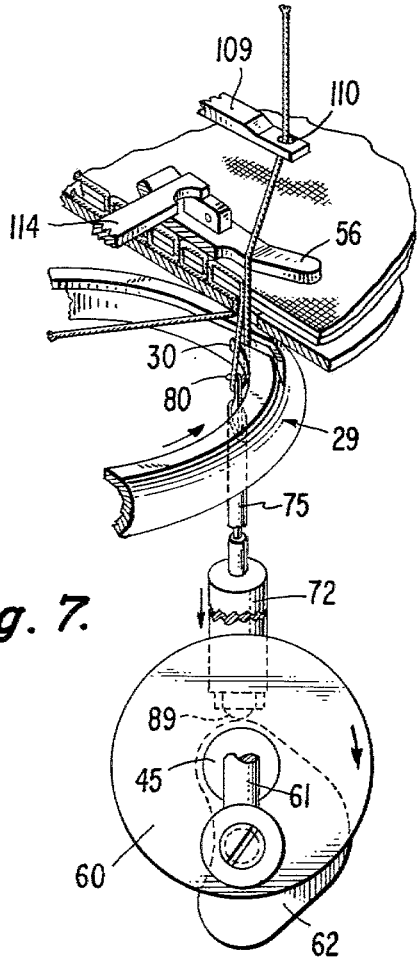
FIG. 7 is a perspective view of a portion of the looptaker, needle looper assembly, work material and thread manipulating members indicating the positions thereof at the moment of loop seizure.

In FIG. 7 there is shown a view of the needle looper assembly 66 in the lowermost position with the inner needle bar 80 extended from the outer needle bar 75. When the inner needle bar 80 is elevated by the cam disk 62 to extend out of the outer needle bar 75, the tension on the upper thread is relieved and a loop is thrown which may be picked up by the beak 30 of the looptaker 29, and enlarged about the bobbin case 31 and the bobbin 32 supported therein. In the process of casting the loop about the bobbin case 31, the upper thread is withdrawn from the hook 82 of the inner needle bar 80, as shown in FIG. 8. As the loop is cast about the bobbin case 31, the takeup lever 93 operates as is well known in the sewing machine art, to remove the excess thread from the system. After the upper thread is shed from the needle looper assembly 66, the needle looper assembly may once again rise to an uppermost position to once again draw down an upper thread in preparation for the next succeeding stitch.

Having thus set forth the nature of the invention what is sought to be claimed is:

1. A method for forming a lockstitch comprising the steps of:

a. Piercing a work material from the underside with a hollow outer needle having a sharpened tip;
b. extending an inner hook needle through said hollow interior of said outer needle;
c. deflecting an upper thread into said hook of said inner hook needle;
d. sheathing said inner hook needle within said outer needle;
e. lowering said outer and inner needles and said upper thread through said work material;
f. extending said inner hook needle from said outer needle;
g. taking said upper thread from said inner hook needle; and,
h. casting said upper thread about a bobbin carrying a lower thread thereon.

* * * * *